US009589534B2

(12) United States Patent
Wu

(10) Patent No.: US 9,589,534 B2
(45) Date of Patent: Mar. 7, 2017

(54) SYSTEM AND METHOD FOR CONVERTING RGB DATA TO WRGB DATA

(71) Applicant: Shenzhen China Star Optoelectronics Technology Co., Ltd., Shenzhen, Guangdong (CN)

(72) Inventor: Jinjun Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 92 days.

(21) Appl. No.: 14/426,982

(22) PCT Filed: Nov. 12, 2014

(86) PCT No.: PCT/CN2014/090928

§ 371 (c)(1),
(2) Date: Mar. 9, 2015

(87) PCT Pub. No.: WO2016/070447

PCT Pub. Date: May 12, 2016

(65) Prior Publication Data

US 2016/0335984 A1 Nov. 17, 2016

(30) Foreign Application Priority Data

Nov. 4, 2014 (CN) ..... 2014 1 0614798

(51) Int. Cl.
*G09G 5/02* (2006.01)

(52) U.S. Cl.
CPC ..... *G09G 5/02* (2013.01); *G09G 2320/0242* (2013.01); *G09G 2340/06* (2013.01)

(58) Field of Classification Search
CPC .. G09G 5/02; G09G 5/06; H04N 9/67; H04N 1/6058; G06T 11/001
See application file for complete search history.

(56) References Cited

U.S. PATENT DOCUMENTS 7,664,322 B1 * 2/2010 Wilensky ..... G06K 9/0061 345/589
2006/0083438 A1 * 4/2006 Donomae ..... G06T 5/003 382/254
2007/0121180 A1 * 5/2007 Ogawa ..... H04N 1/6075 358/518

(Continued)

FOREIGN PATENT DOCUMENTS

CN 104103254 A 10/2014

*Primary Examiner* — Todd Buttram
(74) *Attorney, Agent, or Firm* — Andrew C. Cheng

(57) ABSTRACT

The present invention discloses a system for converting RGB data to WRGB data, which includes: a color enhancement assembly, which is configured to conduct color enhancement for input RGB values in order to obtain color-enhanced RGB values; and a four color conversion assembly, which is configured for converting the color-enhanced RGB values into output WRGB values. The present invention also discloses a method for converting RGB data to WRGB data. The system and method for converting RGB data to WRGB data according to the present invention allows for improvement of transmittance of a display device while at the same time increasing saturation of a display image and providing an effect of color enhancement.

14 Claims, 4 Drawing Sheets

(56) References Cited

U.S. PATENT DOCUMENTS

| | | | | |
|---|---|---|---|---|
| 2013/0222414 | A1* | 8/2013 | Ito | G09G 5/02 345/600 |
| 2014/0022271 | A1* | 1/2014 | Lin | G09G 3/36 345/589 |
| 2014/0267442 | A1* | 9/2014 | Lin | G09G 3/3208 345/690 |

* cited by examiner

SYSTEM AND METHOD FOR CONVERTING RGB DATA TO WRGB DATA

BACKGROUND OF THE INVENTION

1. Field of the Invention

The present invention relates to the field of displaying technology, and in particular to a system and a method for converting RGB data to WRGB data.

2. The Related Arts

Heretofore, in a display device that includes for example a liquid crystal display panel or an organic light-emitting diode (OLED) display panel, most are constructed by combining a red (R) sub-pixel unit, a green (G) sub-pixel unit, and a blue (B) sub-pixel unit to form a pixel unit. Through controlling R data of the red sub-pixel unit, G data of the green sub-pixel unit, and B data of blue sub-pixel unit, a color image can be displayed with a desired color to be display on the display panel with a mixture thereof.

With the progress of information technology, various demands for the display panel are increasing and high transmittance, low power consumption, and excellent image formation quality are becoming people's demands for the display panels. The transmittance and mixture efficiency are both low for a conventional displaying way achieved through mixture of three primary colors of RGB and this leads to a large power consumption for the display panel, thereby imposing a limitation for the improvement of the display panels. In light of this, a display panel possessing four-pixel units composed of a red (R) sub-pixel unit, a green (G) sub-pixel unit, a blue (B) sub-pixel unit, and a fourth sub-pixel unit (such as white (W) sub-pixel unit) is currently available for improving the displaying quality of the RBG display panel.

Generally, images or video signals are arranged for storage of information with three channels of RGB. However, for a four pixel unit display panel, four sub-pixel units of WRGB are used for displaying. This requires an output supplied through conversion of an input of GRB data into WRGB data. However, known methods for converting RGB data to WRGB data cannot increase saturation of a display image while enhancing the transmittance and also cannot achieve an effect of color enhancement.

SUMMARY OF THE INVENTION

To overcome the problems of the known art, an object of the present invention is to provide a system for converting RGB data to WRGB data, which comprises: a color enhancement assembly, which is configured to conduct color enhancement for input RGB values in order to obtain color-enhanced RGB values; and a four color conversion assembly, which is configured for converting the color-enhanced RGB values into output WRGB values.

Further, the color enhancement assembly comprises: an HSV conversion component, which is configured for converting the input RGB values to a HSV color space; a sine processing component, which is configured for conducting sine processing for saturation of the HSV color space; and an HSV inverse conversion component, which is configured for converting hue of the HSV color space, brightness of the HSV color space, and the sine-processed saturation of the HSV color space into the color-enhanced RGB values.

Further, the HSV conversion component is further configured to use Equation 1 to convert the input RGB values to the HSV color space, $$h = \begin{cases} 0^\circ, & \text{if } \max = \min \\ 60^\circ \times \dfrac{g-b}{\max-\min} + 0^\circ, & \text{if } \max = r \text{ and } g \geq b \\ 60^\circ \times \dfrac{g-b}{\max-\min} + 360^\circ, & \text{if } \max = r \text{ and } g < b \\ 60^\circ \times \dfrac{b-r}{\max-\min} + 120^\circ, & \text{if } \max = g \\ 60^\circ \times \dfrac{r-g}{\max-\min} + 240^\circ & \text{if } \max = b \end{cases} \quad \text{[Equation 1]}$$

$$s = \begin{cases} 0^\circ, & \text{if } \max = 0 \\ \dfrac{\max-\min}{\max} = 1 - \dfrac{\min}{\max}, & \text{otherwise} \end{cases}$$

$$v = \max$$

where r indicates the input R value; g indicates the input G value; b indicates the input B value; max indicates the maximum value of r, g, b; min indicates the minimum value of r, g, b; h indicates hue of the HSV color space; s indicates saturation of the HSV color space; and v indicates brightness of the HSV color space.

Further, the sine processing component is further configured to use Equation 2 to conduct sine processing for the saturation of the HSV color space, $$s1 = k \times \sin\left(s \times \frac{\pi}{2}\right) \quad \text{[Equation 2]}$$

where s1 indicates the sine-processed saturation of the HSV color space; $0 \leq k \leq 1$; and s indicates the saturation of the HSV color space.

Further, the HSV inverse conversion component is further configured to use Equation 3 to convert the hue of the HSV color space, the brightness of the HSV color space, and the sine-processed saturation of the HSV color space into the color-enhanced RGB values, $$R' = \begin{cases} v, & \text{if } s1 = 0 \\ v, & \text{if } \left\lfloor \dfrac{h}{60^\circ} \right\rfloor = 0 \\ b, & \text{if } \left\lfloor \dfrac{h}{60^\circ} \right\rfloor = 1 \\ a, & \text{if } \left\lfloor \dfrac{h}{60^\circ} \right\rfloor = 2 \\ a, & \text{if } \left\lfloor \dfrac{h}{60^\circ} \right\rfloor = 3 \\ c, & \text{if } \left\lfloor \dfrac{h}{60^\circ} \right\rfloor = 4 \\ v, & \text{if } \left\lfloor \dfrac{h}{60^\circ} \right\rfloor = 5 \end{cases} \quad \text{[Equation 3]}$$

-continued $$G' = \begin{cases} v, & \text{if } s1 = 0 \\ c, & \text{if } \left\lfloor \frac{h}{60^\circ} \right\rfloor = 0 \\ v, & \text{if } \left\lfloor \frac{h}{60^\circ} \right\rfloor = 1 \\ v, & \text{if } \left\lfloor \frac{h}{60^\circ} \right\rfloor = 2 \\ b, & \text{if } \left\lfloor \frac{h}{60^\circ} \right\rfloor = 3 \\ a, & \text{if } \left\lfloor \frac{h}{60^\circ} \right\rfloor = 4 \\ a, & \text{if } \left\lfloor \frac{h}{60^\circ} \right\rfloor = 5 \end{cases}$$

$$B' = \begin{cases} v, & \text{if } s1 = 0 \\ a, & \text{if } \left\lfloor \frac{h}{60^\circ} \right\rfloor = 0 \\ a, & \text{if } \left\lfloor \frac{h}{60^\circ} \right\rfloor = 1 \\ c, & \text{if } \left\lfloor \frac{h}{60^\circ} \right\rfloor = 2 \\ v, & \text{if } \left\lfloor \frac{h}{60^\circ} \right\rfloor = 3 \\ v, & \text{if } \left\lfloor \frac{h}{60^\circ} \right\rfloor = 4 \\ b, & \text{if } \left\lfloor \frac{h}{60^\circ} \right\rfloor = 5 \end{cases}$$

$$a = v \times (1 - s1)$$

$$b = v \times \left(1 - s1 \times \left(\frac{h}{60^\circ} - \left\lfloor \frac{h}{60^\circ} \right\rfloor\right)\right)$$

$$b = v \times \left(1 - s1 \times \left(1 - \frac{h}{60^\circ} + \left\lfloor \frac{h}{60^\circ} \right\rfloor\right)\right)$$

where h indicates the hue of the HSV color space; v indicates the brightness of the HSV color space; s1 indicates the sine-processed saturation of the HSV color space; R' indicates the color-enhanced R value; G' indicates the color-enhanced G value; and B' indicates the color-enhanced B value.

Further, the four color conversion assembly comprises: a first computation component, which is configured for computing corresponding saturation and a brightness enhancement coefficient according to the color-enhanced RGB values; a second computation component, which is configured for computing brightness-enhanced RGB values according to the brightness enhancement coefficient and the color-enhanced RGB values; a white-color determination component, which is configured for selecting a minimum value of the brightness-enhanced RGB values as the output W value; and a three-color determination component, which is configured for computing the output RGB values according to the brightness-enhanced RGB values and the output W value.

Further, the first computation component is further configured to use Equation 4 to compute the corresponding saturation and the brightness enhancement coefficient, $$s2 = 1 - 3 \times \frac{\min(R', G', B')}{R' + G' + B'} \qquad \text{Equation [4]}$$

$$K = 1 + (K_0 - 1) \times (1 - s2)$$

$$K_0 = L2 / L1$$

where s2 indicates the corresponding saturation; R' indicates the color-enhanced R value; G' indicates the color-enhanced G value; B' indicates the color-enhanced B value; Min (R', G', B') indicates the minimum value of R', G', B'; K indicates the brightness enhancement coefficient; L1 indicates a maximum brightness corresponding to the input RGB values; and L2 indicates a maximum brightness corresponding to the output WRGB values.

Further, the second computation component is further configured to use Equation 5 to compute the brightness-enhanced RGB values, $$R_1 = K^{1/r} \times R'$$

$$G_1 = K^{1/r} \times G'$$

$$B_1 = K^{1/r} \times B' \qquad \text{Equation [5]}$$

where R' indicates the color-enhanced R value; G' indicates the color-enhanced G value; B' indicates the color-enhanced B value; K indicates the brightness enhancement coefficient; $R_1$ indicates the brightness-enhanced R value, $G_1$ indicates the brightness-enhanced G value, $B_1$ indicates the brightness-enhanced B value, and γ indicates gamma value.

Further, the three-color determination component is further configured to use Equation 6 to compute the output RGB values, $$R_2 = (R_1^r - R_b^r)^{1/r}$$

$$G_2 = (G_1^r - G_b^r)^{1/r}$$

$$B_2 = (B_1^r - B_b^r)^{1/r}$$

$$R_b + G_b + B_b = W_2 \qquad \text{Equation [6]}$$

where $R_2$ indicates the output R value; $G_2$ indicates the output G value; $B_2$ indicates the output B value; $W_2$ indicates the output outputted W value; γ indicates gamma value; $R_1$ indicates the brightness-enhanced R value; $G_1$ indicates the brightness-enhanced G value; and $B_1$ indicates the brightness-enhanced B value.

Another object of the present invention is to provide a method for converting RGB data to WRGB data, which comprises: subjecting input RGB values to color enhancement in order to obtain color-enhanced RGB values; and converting the color-enhanced RGB values into output WRGB values.

Further, a process for subjecting input RGB values to color enhancement in order to obtain color-enhanced RGB values comprises: converting the input RGB values into a HSV color space; subjecting saturation of the HSV color space to sine processing; and converting hue of the HSV color space, brightness of the HSV color space, and the sine-processed saturation of the HSV color space into color-enhanced RGB values.

Further, Equation 1 is used to convert the input RGB values to the HSV color space, $$h = \begin{cases} 0^\circ, & \text{if } \max = \min \\ 60^\circ \times \frac{g - b}{\max - \min} + 0^\circ, & \text{if } \max = r \text{ and } g \geq b \\ 60^\circ \times \frac{g - b}{\max - \min} + 360^\circ, & \text{if } \max = r \text{ and } g < b \\ 60^\circ \times \frac{b - r}{\max - \min} + 120^\circ, & \text{if } \max = g \\ 60^\circ \times \frac{r - g}{\max - \min} + 240^\circ & \text{if } \max = b \end{cases} \qquad \text{[Equation 1]}$$

-continued $$s = \begin{cases} 0°, & \text{if } \max = 0 \\ \frac{\max - \min}{\max} = 1 - \frac{\min}{\max}, & \text{otherwise} \end{cases}$$

$$v = \max$$

where r indicates the input R value; g indicates the input G value; b indicates the input B value; max indicates the maximum value of r, g, b; min indicates the minimum value of r, g, b; h indicates hue of the HSV color space; s indicates saturation of the HSV color space; and vindicates brightness of the HSV color space.

Further, Equation 2 is used to conducting the sine processing of the saturation of the HSV color space, $$s1 = k \times \sin\left(s \times \frac{\pi}{2}\right) \quad \text{[Equation 2]}$$

where s1 indicates the sine-processed saturation of the HSV color space; 0≤k≤1; and s indicates the saturation of the HSV color space.

Further, Equation 3 is used to convert the hue of the HSV color space, the brightness of the HSV color space, and the sine-processed saturation of the HSV color space into the color-enhanced RGB values, $$R' = \begin{cases} v, & \text{if } s1 = 0 \\ v, & \text{if } \left\lfloor \frac{h}{60°} \right\rfloor = 0 \\ b, & \text{if } \left\lfloor \frac{h}{60°} \right\rfloor = 1 \\ a, & \text{if } \left\lfloor \frac{h}{60°} \right\rfloor = 2 \\ a, & \text{if } \left\lfloor \frac{h}{60°} \right\rfloor = 3 \\ c, & \text{if } \left\lfloor \frac{h}{60°} \right\rfloor = 4 \\ v, & \text{if } \left\lfloor \frac{h}{60°} \right\rfloor = 5 \end{cases} \quad \text{[Equation 3]}$$

$$G' = \begin{cases} v, & \text{if } s1 = 0 \\ c, & \text{if } \left\lfloor \frac{h}{60°} \right\rfloor = 0 \\ v, & \text{if } \left\lfloor \frac{h}{60°} \right\rfloor = 1 \\ v, & \text{if } \left\lfloor \frac{h}{60°} \right\rfloor = 2 \\ b, & \text{if } \left\lfloor \frac{h}{60°} \right\rfloor = 3 \\ a, & \text{if } \left\lfloor \frac{h}{60°} \right\rfloor = 4 \\ a, & \text{if } \left\lfloor \frac{h}{60°} \right\rfloor = 5 \end{cases}$$

-continued $$B' = \begin{cases} v, & \text{if } s1 = 0 \\ a, & \text{if } \left\lfloor \frac{h}{60°} \right\rfloor = 0 \\ a, & \text{if } \left\lfloor \frac{h}{60°} \right\rfloor = 1 \\ c, & \text{if } \left\lfloor \frac{h}{60°} \right\rfloor = 2 \\ v, & \text{if } \left\lfloor \frac{h}{60°} \right\rfloor = 3 \\ v, & \text{if } \left\lfloor \frac{h}{60°} \right\rfloor = 4 \\ b, & \text{if } \left\lfloor \frac{h}{60°} \right\rfloor = 5 \end{cases}$$

$$a = v \times (1 - s1)$$

$$b = v \times \left(1 - s1 \times \left(\frac{h}{60°} - \left\lfloor \frac{h}{60°} \right\rfloor\right)\right)$$

$$b = v \times \left(1 - s1 \times \left(1 - \frac{h}{60°} + \left\lfloor \frac{h}{60°} \right\rfloor\right)\right)$$

where h indicates the hue of the HSV color space; v indicates the brightness of the HSV color space; s1 indicates the sine-processed saturation of the HSV color space; R' indicates the color-enhanced R value; G' indicates the color-enhanced G value; and B' indicates the color-enhanced B value.

Further, a process for converting the color-enhanced RGB values into output WRGB values comprises: computing corresponding saturation and a brightness enhancement coefficient according to the color-enhanced RGB values; computing brightness-enhanced RGB values according to the brightness enhancement coefficient and the color-enhanced RGB values; selecting a minimum value of the brightness-enhanced RGB values as an output W value; and computing output RGB values according to the brightness-enhanced RGB values and the output W value.

Further, Equation 4 is used to compute the corresponding saturation and the brightness enhancement coefficient, $$s2 = 1 - 3 \times \frac{\min(R', G', B')}{R' + G' + B'} \quad \text{Equation [4]}$$

$$K = 1 + (K_0 - 1) \times (1 - s2)$$

$$K_0 = L2 / L1$$

where s2 indicates the corresponding saturation; R' indicates the color-enhanced R value; G' indicates the color-enhanced G value; B' indicates the color-enhanced B value; Min (R', G', B') indicates the minimum value of R', G', B'; K indicates the brightness enhancement coefficient; L1 indicates a maximum brightness corresponding to the input RGB values; and L2 indicates a maximum brightness corresponding to the output WRGB values.

Further, Equation 5 is used to compute the brightness-enhanced RGB values, $$R_1 = K^{1/r} \times R'$$

$$G_1 = K^{1/r} \times G'$$

$$B_1 = K^{1/r} \times B' \quad \text{Equation [5]}$$

where R' indicates the color-enhanced R value; G' indicates the color-enhanced G value; B' indicates the color-enhanced B value; K indicates the brightness enhancement coefficient;

$R_1$ indicates the brightness-enhanced R value, $G_1$ indicates the brightness-enhanced G value, $B_1$ indicates the brightness-enhanced B value, and γ indicates gamma value.

Further, Equation 6 is used to compute the output RGB values, $$R_2=(R_1^r-R_b^r)^{1/r}$$

$$G_2=(G_1^r-G_b^r)^{1/r}$$

$$B_2=(B_1^r-B_b^r)^{1/r}$$

$$R_b+G_b+B_b=W_2 \quad \text{Equation [6]}$$

where $R_2$ indicates the output R value; $G_2$ indicates the output G value; $B_2$ indicates the output B value; $W_2$ indicates the output outputted W value; γ indicates gamma value; $R_1$ indicates the brightness-enhanced R value; $G_1$ indicates the brightness-enhanced G value; and $B_1$ indicates the brightness-enhanced B value.

The system and method for converting RGB data to WRGB data according to the present invention allows for improvement of transmittance of a display device while at the same time increasing saturation of a display image and providing an effect of color enhancement.

BRIEF DESCRIPTION OF THE DRAWINGS

The above and other aspects, features, and advantages of the embodiments of the present invention will become apparent from the following description with reference to the attached drawings. In the drawings.

DETAILED DESCRIPTION OF THE PREFERRED EMBODIMENTS

Embodiments of the present invention will be described in detail with reference to the attached drawings. However, various different forms may be adopted to embody the present invention and the interpretation of the present invention should not be limited to the embodiments described herein. On the contrary, these embodiments are provided for the purposes of explaining the principle and practical applications of the present invention in order to allow other technical persons of the art field to realize various embodiments of the present invention, as well as various modifications fit for specific intended uses.

A display device according to the instant embodiment can be for example a liquid crystal display (LCD) or an organic light-emitting diode (OLED) display device.

Figure 1:
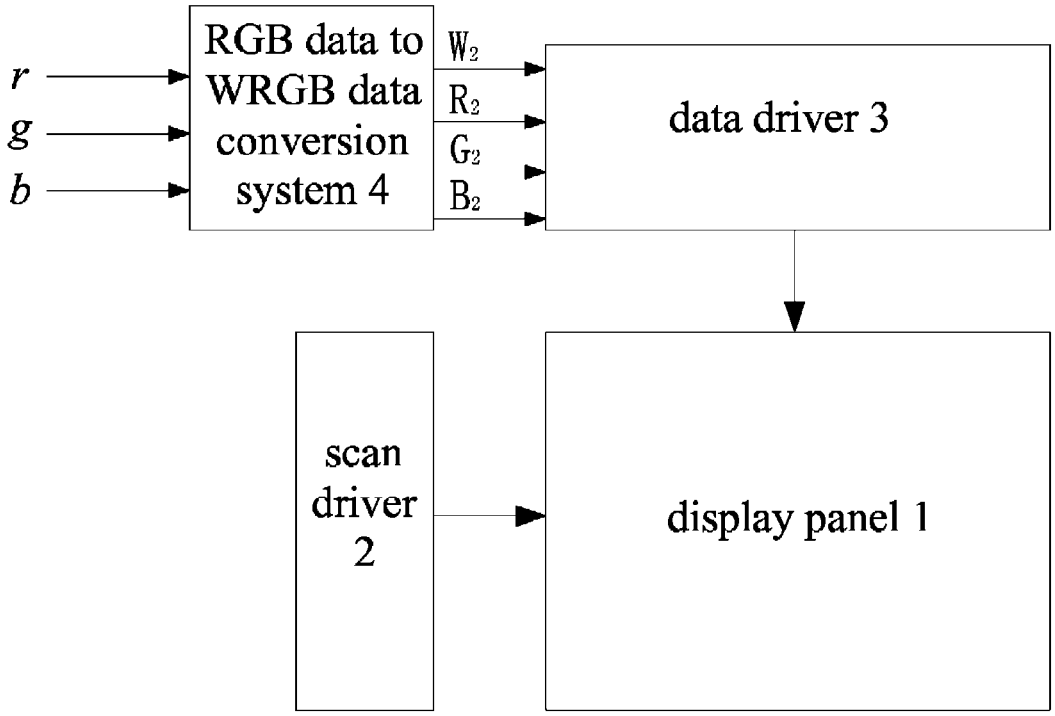
FIG. 1 is a block diagram of a display device according to an embodiment of the present invention.
Figure 2:
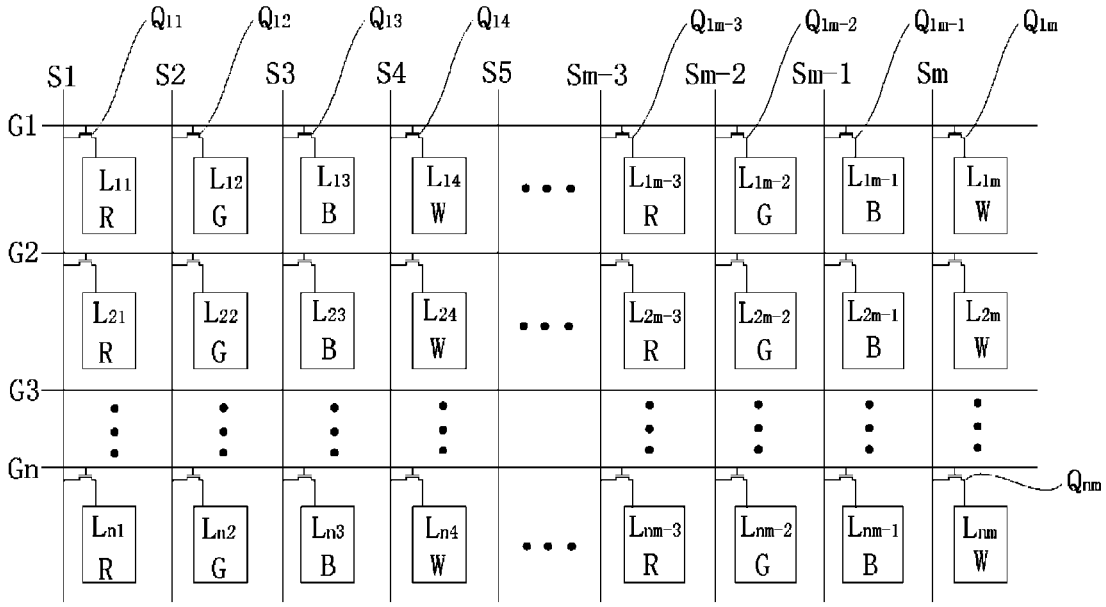
FIG. 2 is a schematic view showing the structure of s display panel according to the embodiment of the present invention.

FIG. 1 is a block diagram of a display device according to an embodiment of the present invention. FIG. 2 is a schematic view showing the structure of the display panel according to the embodiment of the present invention.

Referring to FIGS. 1 and 2, the display device according to the embodiment of the present invention comprises: a display panel 1, a scan driver 2, a data driver 3, and a RGB data (namely RGB values) to WRGB data (namely WRGB values) conversion system 4.

The display panel 1 comprises: scan lines G1 to Gn (where n is a natural number) extending in a row-wise direction and data lines S1 to Sm (where m is a natural number) extending in the column-wise direction. The scan lines G1 to Gn are all connected to the scan driver 2 and the data lines S1 to Sm are all connected to the data driver 3.

Sub-pixels Lij (red (R) sub-pixels or green (G) sub-pixels or blue (B) sub-pixels or white (W) sub-pixels) are arranged in a area delimited by scan lines Gi, Gi+1 (where I is a natural number from 1 to n) and data lines Sj, Sj+1 (where j is a natural number from 1 to m), wherein one red (R) sub-pixel, one green (G) sub-pixel, one blue (B) sub-pixel, and one white (W) sub-pixel collectively constitute a pixel.

A thin-film transistor (TFT) Qij is arranged at each of intersections between scan lines Gi and data lines Sj.

Further, scan line Gi is connected to a gate terminal of the thin-film transistor Qij. Data line Sj is connected to a source terminal of the thin-film transistor Qij. A pixel electrode of sub-pixel Lij (red (R) sub-pixel or green (G) sub-pixel or blue (B) sub-pixel or white (W) sub-pixel) is connected to a drain terminal of the thin-film transistor Qij. A common electrode that is arranged opposite to the pixel electrode of sub-pixel Lij is connected to a common voltage circuit (not shown).

The scan driver 2 and the data driver 3 are arranged at a circumference of the display panel 1. The RGB data to WRGB data conversion system 4 convert input RGB values into output WRGB values and supplies the output WRGB values to the data driver 3. Here, the input RGB values can be supplied from for example an external host device or a graphics controller (not shown).

The data driver 3 receives and processes the output WRGB values supplied from the RGB data to WRGB data conversion system 4 and generates simulation type data signals supplied to data lines S1 to Sm. The scan driver 2 sequentially supplies multiple scan signals to scan lines G1 to Gn. The display panel 1 displays an image through the simulation type data signals supplied from the data driver 3 and the scan signals supplied from the scan driver 2.

A detailed description will be given to the RGB data to WRGB data conversion system 4 according to an embodiment of the present invention.

Figure 3:
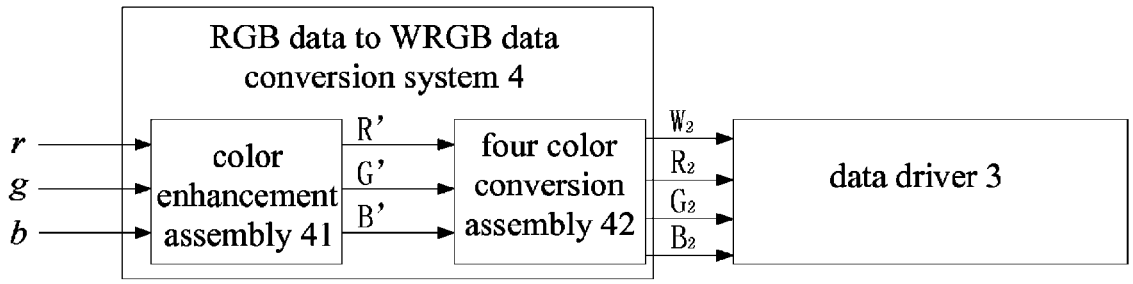
FIG. 3 is a block diagram illustrating an operation principle of a RGB data to WRGB data conversion system according to the embodiment of the present invention.

FIG. 3 is a block diagram illustrating an operation principle of the RGB data to WRGB data conversion system according to the embodiment of the present invention.

Referring to FIG. 3, the RGB data to WRGB data conversion system 4 according to the embodiment of the present invention comprises: a color enhancement assembly 41 and a four color conversion assembly 42.

The color enhancement assembly 41 is constructed to conduct color enhancement for the input RGB values in order to obtain color-enhanced RGB values. In the instant embodiment, r indicates an input R value; g indicates an input G value; b indicates an input B value; and R' indicates a color-enhanced R value; G' indicates a color-enhanced G value; B' indicates a color-enhanced B value. The four color conversion assembly 42 is constructed to convert the color-enhanced RGB values into output WRGB values and supplies the output WRGB values to the data driver 3. In the instant embodiment, $R_2$ indicates an output R value; $G_2$ indicates an output G value; $B_2$ indicates an output B value; and $W_2$ indicates an output outputted W value.

Figure 4:
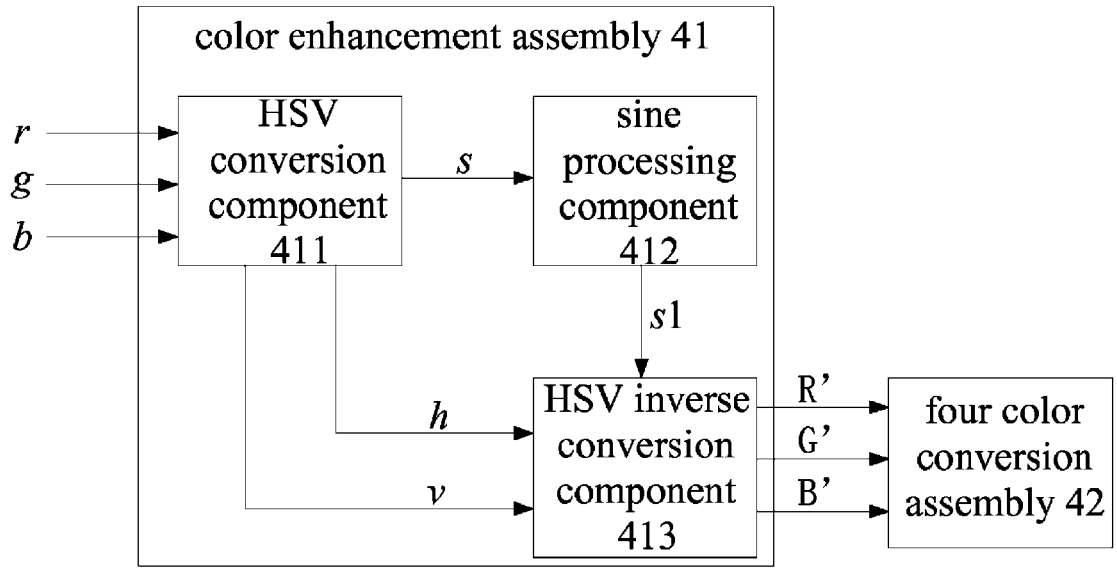
FIG. 4 is a block diagram illustrating an operation principle of a color enhancement assembly according to the embodiment of the present invention.

FIG. 4 is a block diagram illustrating an operation principle of the color enhancement assembly according to the embodiment of the present invention.

Referring to FIG. 4, the color enhancement assembly 41 according to the embodiment of the present invention comprises: an HSV conversion component 411, a sine processing component 412, and an HSV inverse conversion component 413.

Specifically, the HSV conversion component 411 is constructed to convert the input RGB values into an HSV (hue, saturation, and brightness) color space. Further, the HSV conversion component 411 uses the following Equation 1 to convert the input RGB values to the HSV color space.

$$h = \begin{cases} 0^\circ, & \text{if } \max = \min \\ 60^\circ \times \dfrac{g-b}{\max-\min} + 0^\circ, & \text{if } \max = r \text{ and } g \geq b \\ 60^\circ \times \dfrac{g-b}{\max-\min} + 360^\circ, & \text{if } \max = r \text{ and } g < b \\ 60^\circ \times \dfrac{b-r}{\max-\min} + 120^\circ, & \text{if } \max = g \\ 60^\circ \times \dfrac{r-g}{\max-\min} + 240^\circ, & \text{if } \max = b \end{cases} \quad \text{[Equation 1]}$$

$$s = \begin{cases} 0^\circ, & \text{if } \max = 0 \\ \dfrac{\max-\min}{\max} = 1 - \dfrac{\min}{\max}, & \text{otherwise} \end{cases}$$

$$v = \max$$

Here, max indicates the maximum value of r, g, b; min indicates the minimum value of r, g, b; h indicates hue of the HSV color space; s indicates saturation of the HSV color space (that is the saturation of the HSV color space that is not subject to sine processing conducted by the sine processing component 412); and v indicates brightness of the HSV color space.

The HSV conversion component 411 supplied the saturation of the HSV color space so converted to the sine processing component 412. The sine processing component 412 receives the saturation of the HSV color space supplied from the HSV conversion component 411 and conducts sine processing on the saturation of the HSV color space so received. Further, the sine processing component 412 uses the following Equation 2 to conduct the sine processing on the saturation of the HSV color space.

$$s1 = k \times \sin\left(s \times \frac{\pi}{2}\right) \quad \text{[Equation 2]}$$

where s1 indicates the sine-processed saturation of the HSV color space; $0 \leq k \leq 1$; and s indicates the saturation of the HSV color space.

The HSV conversion component 411 supplies the hue of the HSV color space and the brightness of the HSV color space so converted to the HSV inverse conversion component 413 and the sine processing component 412 supplies the sine-processed saturation of the HSV color space to the HSV inverse conversion component 413. The HSV inverse conversion component 413 receives the hue of the HSV color space and the brightness of the HSV color space supplied from the HSV conversion component 411 and the sine-processed saturation of the HSV color space supplied from the sine processing component 412 and convert the hue of the HSV color space, the brightness of the HSV color space, and the sine-processed saturation of the HSV color space so received into color-enhanced RGB values. Further, the HSV inverse conversion component 413 uses the following Equation 3 to convert the hue of the HSV color space, the brightness of the HSV color space, and the sine-processed saturation into the color-enhanced RGB values.

$$R' = \begin{cases} v, & \text{if } s1 = 0 \\ v, & \text{if } \left\lfloor \dfrac{h}{60^\circ} \right\rfloor = 0 \\ b, & \text{if } \left\lfloor \dfrac{h}{60^\circ} \right\rfloor = 1 \\ a, & \text{if } \left\lfloor \dfrac{h}{60^\circ} \right\rfloor = 2 \\ a, & \text{if } \left\lfloor \dfrac{h}{60^\circ} \right\rfloor = 3 \\ c, & \text{if } \left\lfloor \dfrac{h}{60^\circ} \right\rfloor = 4 \\ v, & \text{if } \left\lfloor \dfrac{h}{60^\circ} \right\rfloor = 5 \end{cases} \quad \text{[Equation 3]}$$

$$G' = \begin{cases} v, & \text{if } s1 = 0 \\ c, & \text{if } \left\lfloor \dfrac{h}{60^\circ} \right\rfloor = 0 \\ v, & \text{if } \left\lfloor \dfrac{h}{60^\circ} \right\rfloor = 1 \\ v, & \text{if } \left\lfloor \dfrac{h}{60^\circ} \right\rfloor = 2 \\ b, & \text{if } \left\lfloor \dfrac{h}{60^\circ} \right\rfloor = 3 \\ a, & \text{if } \left\lfloor \dfrac{h}{60^\circ} \right\rfloor = 4 \\ a, & \text{if } \left\lfloor \dfrac{h}{60^\circ} \right\rfloor = 5 \end{cases}$$

$$B' = \begin{cases} v, & \text{if } s1 = 0 \\ a, & \text{if } \left\lfloor \dfrac{h}{60^\circ} \right\rfloor = 0 \\ a, & \text{if } \left\lfloor \dfrac{h}{60^\circ} \right\rfloor = 1 \\ c, & \text{if } \left\lfloor \dfrac{h}{60^\circ} \right\rfloor = 2 \\ v, & \text{if } \left\lfloor \dfrac{h}{60^\circ} \right\rfloor = 3 \\ v, & \text{if } \left\lfloor \dfrac{h}{60^\circ} \right\rfloor = 4 \\ b, & \text{if } \left\lfloor \dfrac{h}{60^\circ} \right\rfloor = 5 \end{cases}$$

Here, $$a = v \times (1 - s1),$$

$$b = v \times \left(1 - s1 \times \left(\frac{h}{60^\circ} - \left\lfloor \frac{h}{60^\circ} \right\rfloor\right)\right), \text{ and}$$

$$b = v \times \left(1 - s1 \times \left(1 - \frac{h}{60^\circ} + \left\lfloor \frac{h}{60^\circ} \right\rfloor\right)\right).$$

Figure 5:
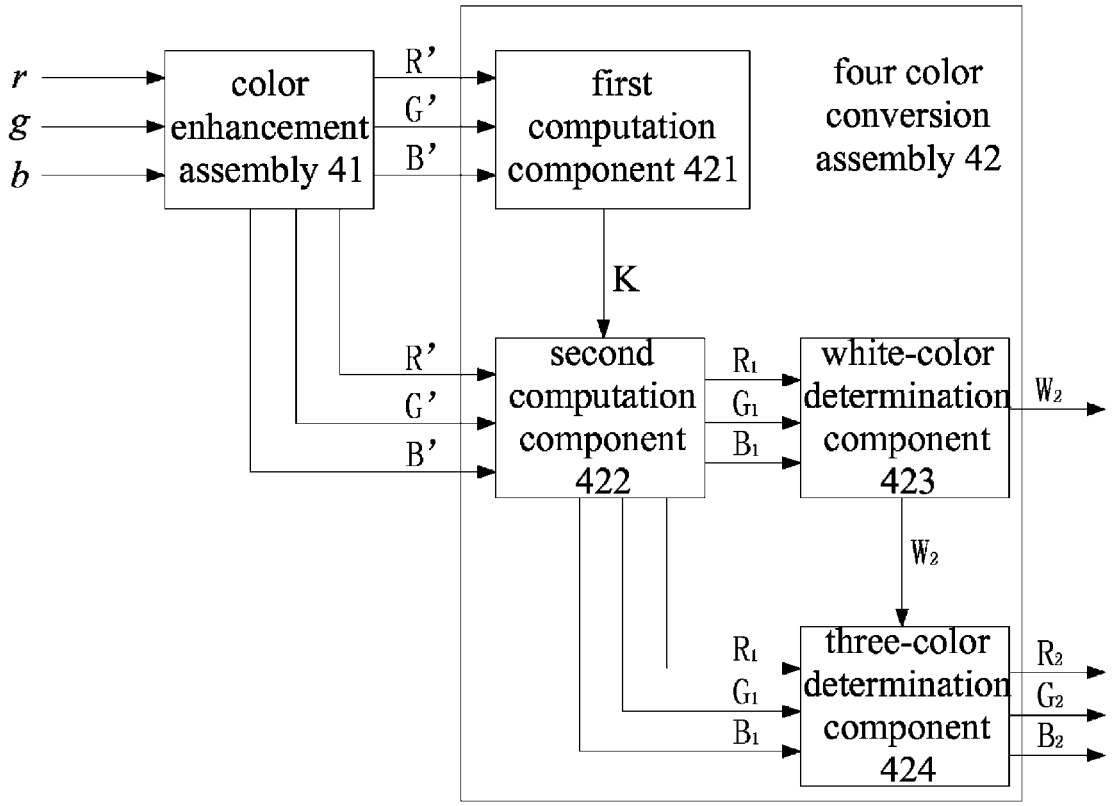
FIG. 5 is a block diagram illustrating an operation principle of a four color conversion assembly according to the embodiment of the present invention.

FIG. 5 is a block diagram illustrating an operation principle of the four color conversion assembly according to the embodiment of the present invention.

Referring to FIG. 5, the four color conversion assembly 42 according to the embodiment of the present invention comprises: a first computation component 421, a second computation component 422, a white-color determination component 423, and a three-color determination component 424.

Specifically, the HSV inverse conversion component 413 supplies the color-enhanced RGB values to the first computation component 421 and the second computation component 422. The first computation component 421 receives the color-enhanced RGB values supplied from the HSV inverse conversion component 413 and computes corresponding saturation and brightness enhancement coefficients according to the color-enhanced RGB values so received. Here, the corresponding saturation indicates the saturation corresponding to the color-enhanced RGB values.

Further, the first computation component 421 uses the following Equation 4 to conduct computation of the corresponding saturation and the brightness enhancement coefficient.

$$s2 = 1 - 3 \times \frac{\min(R', G', B')}{R' + G' + B'} \qquad \text{Equation [4]}$$

$$K = 1 + (K_0 - 1) \times (1 - s2)$$

$$K_0 = L2 / L1$$

where s2 indicates the corresponding saturation; Min (R', G', B') indicates the minimum value of R', G', B'; K indicates the brightness enhancement coefficient; L1 indicates a maximum brightness corresponding to the input RGB values; and L2 indicates a maximum brightness corresponding to the output WRGB values.

Further, the first computation component 421 may alternatively use the following Equation 4' to compute the corresponding saturation and the brightness enhancement coefficient.

$$s2 = 1 - \frac{\min(R', G', B')}{\max(R', G', B')} \qquad \text{Equation [4']}$$

$$K = 1 + (K_0 - 1) \times (1 - s2)$$

$$K_0 = L2 / L1$$

where s2 indicates the corresponding saturation; Min (R', G', B') indicates the minimum value of R', G', B'; Max (R', G', B') indicates the maximum value of R', G', B'; K indicates the brightness enhancement coefficient; L1 indicates a maximum brightness corresponding to the input RGB values; and L2 indicates a maximum brightness corresponding to the output WRGB values.

The first computation component 421 supplies the brightness enhancement coefficient computed thereby to the second computation component 422. The second computation component 422 receives the color-enhanced RGB values supplied from the HSV inverse conversion component 413 and the brightness enhancement supplied from the first computation component 421 coefficient and compute brightness—the RGB values according to the color-enhanced RGB values and the brightness enhancement coefficient so received. Further, the second computation component 422 uses the following Equation 5 to compute the brightness-enhanced RGB values.

$$R_1 = K^{1/r} \times R'$$

$$G_1 = K^{1/r} \times G'$$

$$B_1 = K^{1/r} \times B' \qquad \text{Equation [5]}$$

Here, $R_1$ indicates the brightness-enhanced R value, $G_1$ indicates the brightness-enhanced G value, $B_1$ indicates the brightness-enhanced B value, and $\gamma$ indicates gamma value.

The second computation component 422 supplies the brightness-enhanced RGB values computed thereby to the white-color determination component 423 and the three-color determination component 424. The white-color determination component 423 receives the brightness-enhanced RGB values supplied from the second computation component 422 and selects the minimum value of the brightness-enhanced RGB values, namely Min ($R_1$, $G_1$, $B_1$), as an output W value. Here, if the output W value is greater than 255, then the white-color determination component 423 sets the output W value as 255.

The white-color determination component 423 supplied the output W value determined thereby to the three-color determination component 424. The three-color determination component 424 receives the brightness-enhanced RGB values supplied from the second computation component 422 and the output W value supplied from the white-color determination component 423 and computer output RGB values according to the brightness-enhanced RGB values and the output W value so received. Further, the three-color determination component 424 uses the following Equation 6 to compute the output RGB values.

$$R_2 = (R_1^r - R_b^r)^{1/r}$$

$$G_2 = (G_1^r - G_b^r)^{1/r}$$

$$B_2 = (B_1^r - B_b^r)^{1/r}$$

$$R_b + G_b + B_b = W_2 \qquad \text{Equation [6]}$$

The white-color determination component 423 supplies the output W value determined thereby to the data driver 3 and the three-color determination component 424 also supplies the output RGB values computed thereby to the data driver 3.

Figure 6:
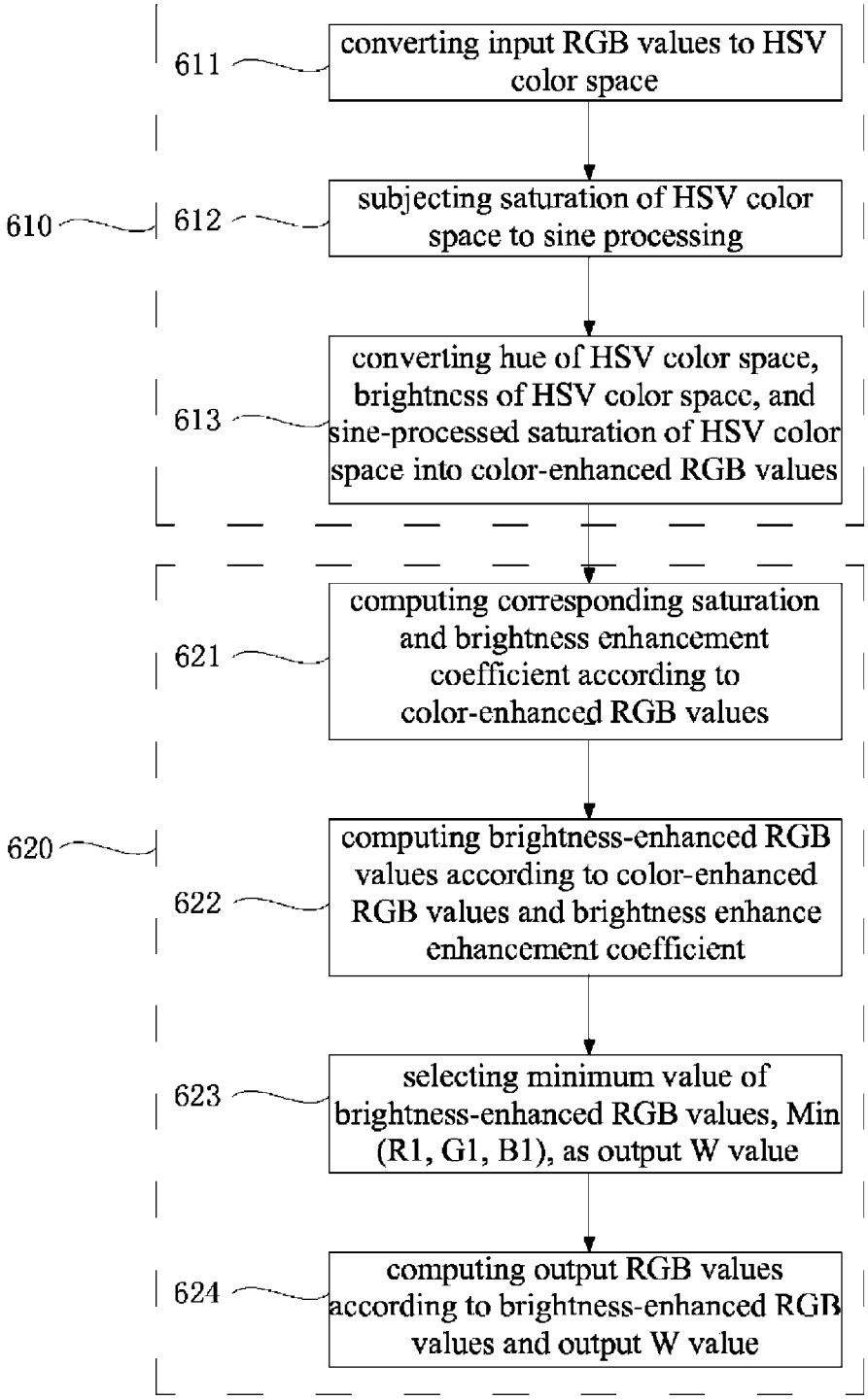
FIG. 6 is a flow chart illustrating a RGB data to WRGB data conversion method according to an embodiment of the present invention.

FIG. 6 is a flow chart illustrating a RGB data to WRGB data conversion method according to an embodiment of the present invention.

Referring to FIG. 6, in Step 610, the input RGB values are subjected to color enhancement in order to obtain color-enhanced RGB values.

A specific process of Step 610 comprises:

Step 611: converting the input RGB values into a HSV (hue, saturation, and brightness) color space. Further, in Step 611, the above-mentioned Equation 1 is used to convert the input RGB values into the HSV color space.

Step 612: subjecting saturation of the HSV color space to sine processing. Further, in Step 612, the above-mentioned Equation 2 is used to conduct the sine processing of the saturation of the HSV color space.

Step 613: converting hue of the HSV color space, brightness of the HSV color space, and the sine-processed saturation of the HSV color space into color-enhanced RGB values. Further, in Step 613, the above-mentioned Equation 3 is used to convert the hue of the HSV color space, the brightness of the HSV color space and the sine processed saturation into the color-enhanced RGB values.

In Step 620, the color-enhanced RGB values are converted into output WRGB values and the output WRGB values are supplied to the data driver 3.

A specific process of Step 620 comprises:

Step 621: computing corresponding saturation and a brightness enhancement coefficient according to the color-enhanced RGB values. Here, the corresponding saturation indicates saturation that corresponds to the color-enhanced RGB values. Further, in Step 621, the above-mentioned Equation 4 or Equation 4' is used to compute the corresponding saturation and the brightness enhancement coefficient.

Step 622: computing brightness-enhanced RGB values according to the color-enhanced RGB values and the brightness enhancement coefficient. Further, in Step 622, the above-mentioned Equation 5 is used to compute the brightness-enhanced RGB values.

Step 623: selecting a minimum value of the brightness-enhanced RGB values, namely Min ($R_1$, $G_1$, $B_1$), as an output W value. Here, if the output W value is greater than 255, then the white-color determination component 423 sets the output W value as 255.

Step 624: computing output RGB values according to the brightness-enhanced RGB values and the output W value. Further, in Step 624, the above-mentioned Equation 6 is used to compute the output RGB values.

In summary, the system and method for converting RGB data to WRGB data according to an embodiment of the present invention allow for improvement of transmittance of a display device while at the same time increasing saturation of a display image and providing an effect of color enhancement.

Although a description of specific embodiment has been given to illustrate the present invention, those having ordinary skills of the art may appreciate that various variations in respect of forms and details can be made without departing the spirit and scope of the present invention that are only limited by the appended claims and the equivalents thereof.

What is claimed is:

1. A display device comprising a display panel, a scan driver, a data driver, and an RGB (Red, Green, Blue) data to WRGB (White, Red, Green, Blue) data conversion system, and also comprising scan lines connected to the scan driver and data lines connected to the data driver, the scan lines and the data lines being interconnected to define red sub-pixels, green sub-pixels, blue sub-pixels, and white sub-pixels that respectively and collectively constitute pixels, the RGB data to WRGB data conversion system being configured to receive input RGB values and comprising:

a color enhancement assembly, which is configured to receive the input RGB values and conduct color enhancement for the input RGB values in order to obtain color-enhanced RGB values; and a four color conversion assembly, which is configured for receiving and converting the color-enhanced RGB values into output WRGB values that are fed to the data driver to be supplied from the data driver to the display panel for displaying;

wherein the color enhancement assembly comprises:

an HSV (Hue, Saturation, Value) conversion component, which is configured for converting the input RGB values to an HSV color space;

a sine processing component, which is configured for conducting sine processing for saturation of the HSV color space; and an HSV inverse conversion component, which is configured for converting hue of the HSV color space, brightness of the HSV color space, and the sine-processed saturation of the HSV color space into the color-enhanced RGB values; and wherein the HSV conversion component is further configured to use Equation 1 to convert the input RGB values to the HSV color space, $$h = \begin{cases} 0^\circ, & \text{if } \max = \min \\ 60^\circ \times \dfrac{g-b}{\max - \min} + 0^\circ, & \text{if } \max = r \text{ and } g \geq b \\ 60^\circ \times \dfrac{g-b}{\max - \min} + 360^\circ, & \text{if } \max = r \text{ and } g < b \\ 60^\circ \times \dfrac{b-r}{\max - \min} + 120^\circ, & \text{if } \max = g \\ 60^\circ \times \dfrac{r-g}{\max - \min} + 240^\circ, & \text{if } \max = b \end{cases} \quad \text{[Equation 1]}$$

$$s = \begin{cases} 0^\circ, & \text{if } \max = 0 \\ \dfrac{\max - \min}{\max} = 1 - \dfrac{\min}{\max}, & \text{otherwise} \end{cases}$$

$$v = \max$$

where r indicates the input R value; g indicates the input G value; b indicates the input B value; max indicates the maximum value of r, g, b; min indicates the minimum value of r, g, b; h indicates hue of the HSV color space; s indicates saturation of the HSV color space; and v indicates brightness of the HSV color space.

2. The display device as claimed in claim 1, wherein the sine processing component is further configured to use Equation 2 to conduct sine processing for the saturation of the HSV color space, $$s1 = k \times \sin\left(s \times \frac{\pi}{2}\right) \quad \text{[Equation 2]}$$

where s1 indicates the sine-processed saturation of the HSV color space; 0<k<1; and s indicates the saturation of the HSV color space.

3. The display device as claimed in claim 1, wherein the HSV inverse conversion component is further configured to use Equation 3 to convert the hue of the HSV color space, the brightness of the HSV color space, and the sine-processed saturation of the HSV color space into the color-enhanced RGB values, $$R' = \begin{cases} v, & \text{if } s1 = 0 \\ v, & \text{if } \left\lfloor \dfrac{h}{60^\circ} \right\rfloor = 0 \\ b, & \text{if } \left\lfloor \dfrac{h}{60^\circ} \right\rfloor = 1 \\ a, & \text{if } \left\lfloor \dfrac{h}{60^\circ} \right\rfloor = 2 \\ a, & \text{if } \left\lfloor \dfrac{h}{60^\circ} \right\rfloor = 3 \\ c, & \text{if } \left\lfloor \dfrac{h}{60^\circ} \right\rfloor = 4 \\ v, & \text{if } \left\lfloor \dfrac{h}{60^\circ} \right\rfloor = 5 \end{cases} \quad \text{[Equation 3]}$$

-continued $$G' = \begin{cases} v, & \text{if } s1 = 0 \\ c, & \text{if } \left\lfloor \frac{h}{60^\circ} \right\rfloor = 0 \\ v, & \text{if } \left\lfloor \frac{h}{60^\circ} \right\rfloor = 1 \\ v, & \text{if } \left\lfloor \frac{h}{60^\circ} \right\rfloor = 2 \\ b, & \text{if } \left\lfloor \frac{h}{60^\circ} \right\rfloor = 3 \\ a, & \text{if } \left\lfloor \frac{h}{60^\circ} \right\rfloor = 4 \\ a, & \text{if } \left\lfloor \frac{h}{60^\circ} \right\rfloor = 5 \end{cases}$$

$$B' = \begin{cases} v, & \text{if } s1 = 0 \\ a, & \text{if } \left\lfloor \frac{h}{60^\circ} \right\rfloor = 0 \\ a, & \text{if } \left\lfloor \frac{h}{60^\circ} \right\rfloor = 1 \\ c, & \text{if } \left\lfloor \frac{h}{60^\circ} \right\rfloor = 2 \\ v, & \text{if } \left\lfloor \frac{h}{60^\circ} \right\rfloor = 3 \\ v, & \text{if } \left\lfloor \frac{h}{60^\circ} \right\rfloor = 4 \\ b, & \text{if } \left\lfloor \frac{h}{60^\circ} \right\rfloor = 5 \end{cases}$$

$$a = v \times (1 - s1)$$

$$b = v \times \left(1 - s1 \times \left(\frac{h}{60^\circ} - \left\lfloor \frac{h}{60^\circ} \right\rfloor\right)\right)$$

$$b = v \times \left(1 - s1 \times \left(1 - \frac{h}{60^\circ} + \left\lfloor \frac{h}{60^\circ} \right\rfloor\right)\right)$$

where h indicates the hue of the HSV color space; v indicates the brightness of the HSV color space; s1 indicates the sine-processed saturation of the HSV color space; R' indicates the color-enhanced R value; G' indicates the color-enhanced G value; and B' indicates the color-enhanced B value.

4. The display device as claimed in claim 1, wherein the four color conversion assembly comprises:

a first computation component, which is configured for computing corresponding saturation and a brightness enhancement coefficient according to the color-enhanced RGB values;

a second computation component, which is configured for computing brightness-enhanced RGB values according to the brightness enhancement coefficient and the color-enhanced RGB values;

a white-color determination component, which is configured for selecting a minimum value of the brightness-enhanced RGB values as the output W value; and a three-color determination component, which is configured for computing the output RGB values according to the brightness-enhanced RGB values and the output W value.

5. The display device as claimed in claim 4, wherein the first computation component is further configured to use Equation 4 to compute the corresponding saturation and the brightness enhancement coefficient, $$s2 = 1 - 3 \times \frac{\min(R', G', B')}{R' + G' + B'} \qquad \text{Equation [4]}$$

-continued $$K = 1 + (K_0 - 1) \times (1 - s2)$$

$$K_0 = \frac{L2}{L1}$$

where s2 indicates the corresponding saturation; R' indicates the color-enhanced R value; G' indicates the color-enhanced G value; B' indicates the color-enhanced B value; Min (R', G', B') indicates the minimum value of R' , G' , B' ; K' indicates the brightness enhancement coefficient; L1 indicates a maximum brightness corresponding to the input RGB values; and L2 indicates a maximum brightness corresponding to the output WRGB values.

6. The conversion system display device as claimed in claim 4, wherein the second computation component is further configured to use Equation 5 to compute the brightness-enhanced RGB values, $$R_1 = K^{1/r} \times R'$$

$$G_1 = K^{1/r} \times G'$$

$$B_1 = K^{1/r} \times B' \qquad \text{Equation [5]}$$

where R' indicates the color-enhanced R value; G' indicates the color-enhanced G value; B' indicates the color-enhanced B value; K indicates the brightness enhancement coefficient; $R_1$indicates the brightness-enhanced R value, $G_1$ indicates the brightness-enhanced G value, $B_1$indicates the brightness-enhanced B value, and γ indicates gamma value.

7. The display device as claimed in claim 4, wherein the three-color determination component is further configured to use Equation 6 to compute the output RGB values, $$R_2 = (R_1^r - R_b^r)^{1/r}$$

$$G_2 = (G_1^r - G_b^r)^{1/r}$$

$$B_2 = (B_1^r - B_b^r)^{1/r}$$

$$R_b + G_b + B_b = W_2 \qquad \text{Equation [6]}$$

where $R_2$ indicates the output R value; $G_2$ indicates the output G value; $B_2$ indicates the output B value; $W_2$ indicates the output outputted W value; γ indicates gamma value; $R_1$ indicates the brightness-enhanced R value; $G_1$ indicates the brightness-enhanced G value; and $B_1$ indicates the brightness-enhanced B value.

8. A conversion method for converting RGB (Red, Green, Blue) values inputted to a display device to an output of WRGB (White, Red, Green, Blue) values to be supplied through a data driver that comprises data lines connected thereto and interconnecting scan lines connected to a scan driver in order to have the WRGB values to be supplied to and displayed on a display panel, wherein the scan lines and data lines interconnected define red sub-pixels, green sub-pixels, blue sub-pixels, and white sub-pixels that respectively and collectively constitute pixels, the conversion method comprising:

subjecting the inputted RGB values to color enhancement in order to obtain color-enhanced RGB values; and converting the color-enhanced RGB values into the output of WRGB values;

wherein a process for subjecting input RGB values to color enhancement in order to obtain color-enhanced RGB values comprises:

converting the inputted RGB values into an HSV (Hue, Saturation, Value) color space;

subjecting saturation of the HSV color space to sine processing; and converting hue of the HSV color space, brightness of the HSV color space, and the sine-processed saturation of the HSV color space into color-enhanced RGB values; and wherein Equation 1 is used to convert the inputted RGB values to the HSV color space, $$h = \begin{cases} 0°, & \text{if } \max = \min \\ 60° \times \frac{g-b}{\max - \min} + 0°, & \text{if } \max = r \text{ and } g \geq b \\ 60° \times \frac{g-b}{\max - \min} + 360°, & \text{if } \max = r \text{ and } g < b \\ 60° \times \frac{b-r}{\max - \min} + 120°, & \text{if } \max = g \\ 60° \times \frac{r-g}{\max - \min} + 240°, & \text{if } \max = b \end{cases} \quad \text{[Equation 1]}$$

$$s = \begin{cases} 0°, & \text{if } \max = 0 \\ \frac{\max - \min}{\max} = 1 - \frac{\min}{\max}, & \text{otherwise} \end{cases}$$

$$v = \max$$

where r indicates the input R value; g indicates the input G value; b indicates the input B value; max indicates the maximum value of r, g, b; min indicates the minimum value of r, g, b; h indicates hue of the HSV color space; s indicates saturation of the HSV color space; and v indicates brightness of the HSV color space.

9. The conversion method as claimed in claim 8, wherein Equation 2 is used to conducting the sine processing of the saturation of the HSV color space, $$s1 = k \times \sin\left(s \times \frac{\pi}{2}\right) \quad \text{[Equation 2]}$$

where s1 indicates the sine-processed saturation of the HSV color space; 0<k<1; and s indicates the saturation of the HSV color space.

10. The conversion method as claimed in claim 8, wherein Equation 3 is used to convert the hue of the HSV color space, the brightness of the HSV color space, and the sine-processed saturation of the HSV color space into the color-enhanced RGB values, $$R' = \begin{cases} v, & \text{if } s1 = 0 \\ v, & \text{if } \left\lfloor \frac{h}{60°} \right\rfloor = 0 \\ b, & \text{if } \left\lfloor \frac{h}{60°} \right\rfloor = 1 \\ a, & \text{if } \left\lfloor \frac{h}{60°} \right\rfloor = 2 \\ a, & \text{if } \left\lfloor \frac{h}{60°} \right\rfloor = 3 \\ c, & \text{if } \left\lfloor \frac{h}{60°} \right\rfloor = 4 \\ v, & \text{if } \left\lfloor \frac{h}{60°} \right\rfloor = 5 \end{cases} \quad \text{[Equation 3]}$$

-continued $$G' = \begin{cases} v, & \text{if } s1 = 0 \\ c, & \text{if } \left\lfloor \frac{h}{60°} \right\rfloor = 0 \\ v, & \text{if } \left\lfloor \frac{h}{60°} \right\rfloor = 1 \\ v, & \text{if } \left\lfloor \frac{h}{60°} \right\rfloor = 2 \\ b, & \text{if } \left\lfloor \frac{h}{60°} \right\rfloor = 3 \\ a, & \text{if } \left\lfloor \frac{h}{60°} \right\rfloor = 4 \\ a, & \text{if } \left\lfloor \frac{h}{60°} \right\rfloor = 5 \end{cases}$$

$$B' = \begin{cases} v, & \text{if } s1 = 0 \\ a, & \text{if } \left\lfloor \frac{h}{60°} \right\rfloor = 0 \\ a, & \text{if } \left\lfloor \frac{h}{60°} \right\rfloor = 1 \\ c, & \text{if } \left\lfloor \frac{h}{60°} \right\rfloor = 2 \\ v, & \text{if } \left\lfloor \frac{h}{60°} \right\rfloor = 3 \\ v, & \text{if } \left\lfloor \frac{h}{60°} \right\rfloor = 4 \\ b, & \text{if } \left\lfloor \frac{h}{60°} \right\rfloor = 5 \end{cases}$$

$$a = v \times (1 - s1)$$

$$b = v \times \left(1 - s1 \times \left(\frac{h}{60°} - \left\lfloor \frac{h}{60°} \right\rfloor\right)\right)$$

$$b = v \times \left(1 - s1 \times \left(1 - \frac{h}{60°} + \left\lfloor \frac{h}{60°} \right\rfloor\right)\right)$$

where h indicates the hue of the HSV color space; v indicates the brightness of the HSV color space; s1 indicates the sine-processed saturation of the HSV color space; R' indicates the color-enhanced R value; G' indicates the color-enhanced G value; and B' indicates the color-enhanced B value.

11. The conversion method as claimed in claim 8, wherein a process for converting the color-enhanced RGB values into output WRGB values comprises:

computing corresponding saturation and a brightness enhancement coefficient according to the color-enhanced RGB values;

computing brightness-enhanced RGB values according to the brightness enhancement coefficient and the color-enhanced RGB values;

selecting a minimum value of the brightness-enhanced RGB values as an output W value; and computing output RGB values according to the brightness-enhanced RGB values and the output W value.

12. The conversion method as claimed in claim 11, wherein Equation 4 is used to compute the corresponding saturation and the brightness enhancement coefficient, $$s2 = 1 - 3 \times \frac{\min(R', G', B')}{R' + G' + B'} \quad \text{Equation [4]}$$

$$K = 1 + (K_0 - 1) \times (1 - s2)$$

$$K_0 = \frac{L2}{L1}$$

where s2 indicates the corresponding saturation; R' indicates the color-enhanced R value; G' indicates the color-enhanced G value; B' indicates the color-enhanced B value; Min (R' , G' , B' ) indicates the minimum value of R', G', B'; K' indicates the brightness enhancement coefficient; L1 indicates a maximum brightness corresponding to the input RGB values; and L2 indicates a maximum brightness corresponding to the output WRGB values.

13. The conversion method as claimed in claim 11, wherein Equation 5 is used to compute the brightness-enhanced RGB values, $$R_1=K^{1/r}\times R'$$

$$G_1=K^{1/r}\times G'$$

$$B_1=K^{1/r}\times B' \qquad \text{Equation [5]}$$

where R' indicates the color-enhanced R value; G' indicates the color-enhanced G value; B' indicates the color-enhanced B value; K ' indicates the brightness enhancement coefficient; $R_1$ indicates the brightness-enhanced R value, $G_1$ indicates the brightness-enhanced G value, $B_1$ indicates the brightness-enhanced B value, and γ indicates gamma value.

14. The conversion method as claimed in claim 11, wherein Equation 6 is used to compute the output RGB values, $$R_2=(R_1^r-R_b^r)^{1/r}$$

$$G_2=(G_1^r-G_b^r)^{1/r}$$

$$B_2=(B_1^r-B_b^r)^{1/r}$$

$$R_b+G_b+B_b=W_2 \qquad \text{Equation [6]}$$

where $R_2$ indicates the output R value; $G_2$ indicates the output G value; $B_2$ indicates the output B value; $W_2$ indicates the output outputted W value; γ indicates gamma value; $R_1$ indicates the brightness-enhanced R value; $G_1$ indicates the brightness-enhanced G value; and $B_1$ indicates the brightness-enhanced B value.

* * * * *